United States Patent [19]

Lavanchy et al.

[11] 4,299,268

[45] Nov. 10, 1981

[54] AUTOMATICALLY CONTROLLED CASTING PLANT

[75] Inventors: Gérard A. Lavanchy, Prilly-Lausanne; Fritz Mezger, Muntelier; Marc-Henri Rossier, Epalinges, all of Switzerland

[73] Assignee: Maschinenfabrik & Eisengiesserei Ed. Mezger AG, Kallnach, Switzerland

[21] Appl. No.: 149,459

[22] Filed: May 13, 1980

[30] Foreign Application Priority Data

Jun. 7, 1979 [CH] Switzerland ..... 5330/79

[51] Int. Cl.[3] ..... B22D 37/00

[52] U.S. Cl. ..... 164/155; 164/335

[58] Field of Search ..... 164/4, 155, 335

[56] References Cited

U.S. PATENT DOCUMENTS

| | | | |
|---|---|---|---|
| 3,343,591 | 9/1967 | Lorang | 164/155 |
| 3,791,437 | 2/1974 | Yamada et al. | 164/155 X |
| 3,818,971 | 6/1974 | Schutz | 164/4 |
| 3,834,587 | 9/1974 | Bengt et al. | 164/155 X |
| 3,842,894 | 10/1974 | Southworth et al. | 164/4 |
| 4,019,563 | 4/1977 | Bergman et al. | 164/155 |
| 4,084,631 | 4/1978 | Kunzmann | 164/4 |
| 4,210,192 | 7/1980 | Lavanchy et al. | 164/4 |
| 4,227,565 | 10/1980 | Lavanchy et al. | 164/155 |

*Primary Examiner*—Robert D. Baldwin

*Attorney, Agent, or Firm*—Stevens, Davis, Miller & Mosher

[57] ABSTRACT

A casting plant comprises a pressure ladle and a small-capacity tilting ladle to regulate the filling of molds making up a casting line and successively moving to a position beneath the tilting ladle. The control system comprises two servo loops. One servo loop includes sensors acting upon a motor to control the angular position of the tilting ladle so that the level of metal in the pouring gate of the mold remains constant during the pouring operation. During this time, an optical sensor, an angular-position sensor, and a pressure sensor included in the other servo loop supply input data which are processed to supply a signal acting upon a valve in a gas line feeding the pressure ladle. This valve regulates the flow of molten metal from the pressure ladle to the tilting ladle so that the quantity of metal contained in the tilting ladle remains substantially constant.

6 Claims, 2 Drawing Figures

AUTOMATICALLY CONTROLLED CASTING PLANT

This invention relates to casting plants, and moe particularly to a casting plant of the type equipped with automatic control means and comprising a pouring ladle containing a reserve of molten metal and a casting line formed of closed molds which are successively moved into a filling position.

Significant developments have been made in recent times in the art of automatically filling sand molds or permanent molds in foundry operations. Thus, for example, German Published Application (DOS) No. 1,242,809 and co-pending commonly assigned U.S. Ser. No. 778,588, now U.S. Pat. No. 4,210,192, describe detection and control means which lead toward automation of casting operations when a series of closed molds is to be filled by pouring metal into a pouring gate at the tops of these molds.

However, certain casting lines turning out relatively small-capacity molds at a fast rate require that the pouring operations be carried out in an extremely short time, so that regulation of the pouring then poses particularly problems. Efficient utilization of such casting lines involves the use of a large-capacity pouring ladle from which a relatively small quantity of metal must be extracted at each operation, but where the flow of this metal must be extremely accurately controlled.

The pouring ladles used for filling molds are generally of either the tilting, bottom-pour, or pressure type. They may be provided with heating means. In order to avoid too frequent interruptions, it is advantageous to use large-capacity ladles, e.g., of the pressure type. In this case, however, the time constant of the ladle grows longer, and its size may lead to difficulties as concerns the regulation and automatic control of the casting operations.

It is an object of this invention to provide an improved automatically controlled casting plant which, while utilizing a large-capacity lade, makes it possible to regulate relatively small flows of metal precisely, taking into account that the flow of metal into the pouring gate must vary rapidly during pouring as a function of irregularities of flow in the sprue. A specific object of this invention is to ensure the desired rapidity in the course of casting operations while maintaining the quality of the castings by causing the level of metal in the pouring gate to remain constant during the filling of each mold.

To give an idea of the conditions to be met, pouring operations lasting as little as four seconds are to be controlled, for example.

U.S. Pat. No. 3,842,894 discloses a method and means for the continuous casting of metal bars or strands wherein an optical scanner continuously measures the level of the free surface of molten metal in a tubular mold in which the casting is formed. The signal transmitted by this scanner acts upon elements controlling the speed at which the cast part is extracted from the cylinder mold, on the one hand, and upon the control motor of valve means regulating the flow of metal from an intermediate reservoir or tundish into the mold, on the other hand. Furthermore, the contents of the intermediate reservoir are maintained substantially constant owing to a measurement of the level of molten metal in that reservoir, a signal corresponding to this measurement serving to control the flow from a holding furnace which feeds the reservoir.

The time constant of such equipment is obviously much greater than that of equipment intended to fill closed molds of a capacity such that they can be filled in a few seconds if need be.

The present invention is the result of the discovery that it is possible to regulate the filling of small closed molds from a large-capacity pressure ladle by using an intermediate ladle in conjunction with an appropriate arrangement of the control means.

Thus, in the casting plant according to the present invention, of the type initially mentioned, the improvement comprises an intermediate ladle which receives a feeding stream from the pouring ladle and pours a filling stream into the pouring gate of a mold which is in the filling position, and control means including sensors capable of continuously indicating at least the height of the level of metal in the pouring gate of the mold being filled and the quantity of metal contained in the intermediate ladle, on the one hand, and control members which regulate the flows of the feeding and filling streams, on the other hand, the arrangement as a whole being such that during each casting operation, the contents of the intermediate ladle vary only within narrow limits, while the level of metal in the pouring gate of the mold is stabilized at a constant height.

Other objects and advantages of the invention will become apparent from the following detailed description of a preferred embodiment thereof, taken in conjunction with the accompanying drawings, in which.

Figure 1:
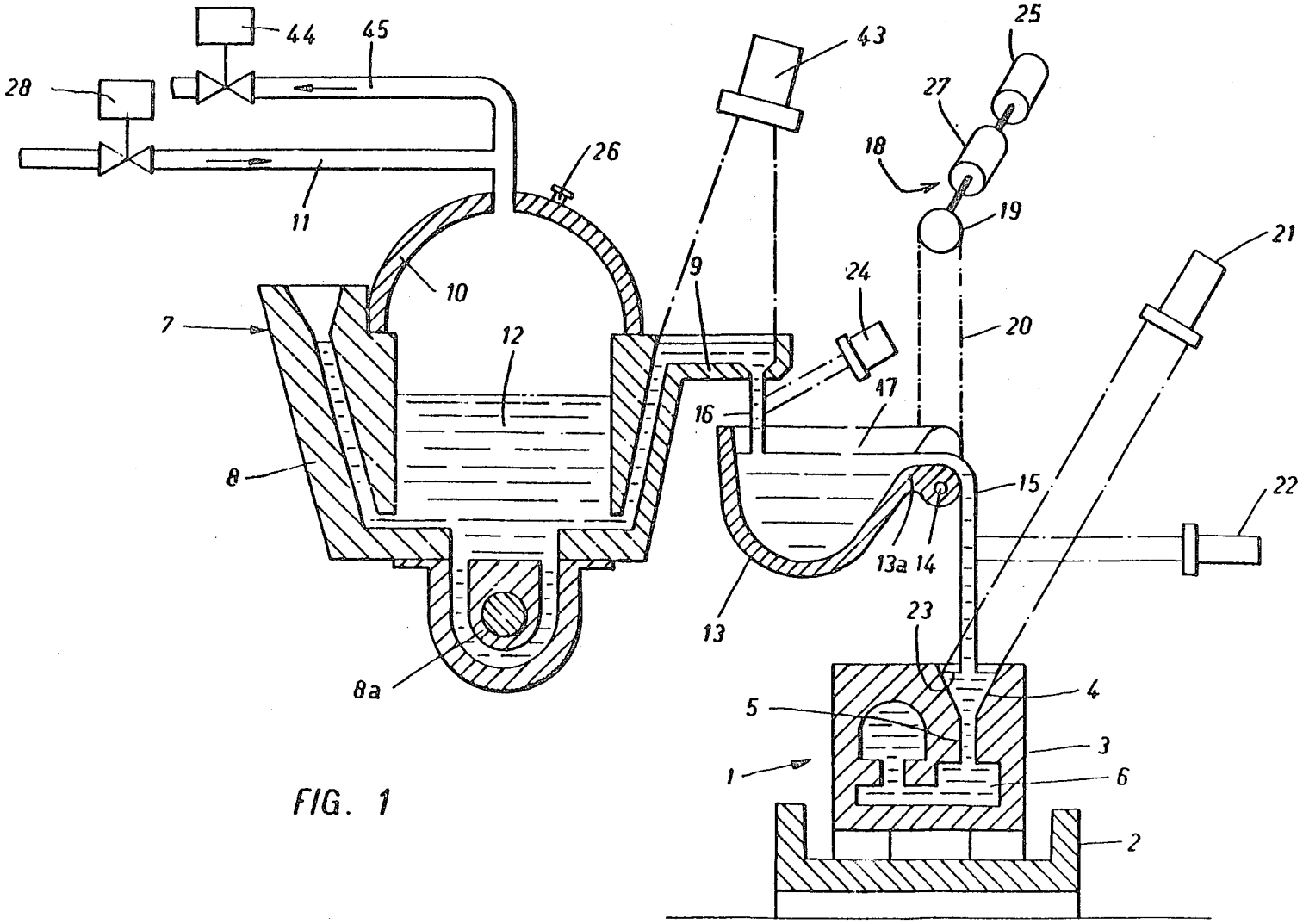
FIG. 1 is a diagrammatic view of the main elements of the casting plant.

FIG. 1 shows a casting line 1 schematically including a track 2 on which there is a succession of molds 3. Each mold 3 includes a sprue cup or pouring gate 4 situated at the top thereof and connected by a sprue 5 to the mold cavity 6 corresponding to the shape of the part to be cast. Molds 3 may be produced by any known method. One such known method is carried out automatically by forming sand snap-molds, each constituting a half of two adjacent molds, these snap-molds being joined to one another to form the complete molds.

The metal which fills each of the molds 3 comes from a large-capacity pressure ladle 7. This ladle is conventionally composed of a bucket 8 equipped with a heating inductor 8a, a lip with a flow-off gate 9, and a bell cover 10 which rises above bucket 8 and is fed with pressurized gas through a pipe 11 so that the metal 12 in bucket 8 is gradually forced through flow-off lip 9. Hence the position of ladle 7 need not be altered during the casting operations. A valve 28 regulates the admission of the gas, which may be nitrogen, for example, through pipe 11. Valve 28 and a discharge pipe 45 equipped with a valve 44 provide for the control of ladle 7.

An intermediate tilting lade 13 is disposed between pressure ladle 7 and mold 3. The capacity of ladle 13 is much smaller than that of ladle 7 and roughly corresponds to the capacity of a mold 3. Ladle 13 is pivotable about a horizontal shaft 14 preferably situated to the right of the lip 13a so that ladle 13 may be tilted without displacing the stream 15 of metal flowing out of ladle 13. The arrangement of ladle 13 is such that stream 15 falls into pouring gate 4, whereas a stream 16 of metal running through flow-off gate 9 reaches ladle 13 and forms a horizontal free surface 7 in that ladle.

The position of intermediate ladle 13 is controlled by means schematically indicated and generally designated by reference numeral 18 in FIG. 1. These means may, for example, include a pulley 19, a chain 20, and another pulley similar to pulley 19 mounted on shaft 14. However, any other control system, such as a lever or jack system, might equally well be used.

The system for controlling and regulating the casting plant illustrated in FIG. 1 will no be described. This system comprises a number of sensors intended to supply electric signals representing certain instantaneous data of the plant. It also comprises control elements capable of acting upon certain parts of the plant in order to regulate its operation. Two optical sensors 21 and 22 are associated with molds 3. Sensor 21 is directed toward the location of pouring gates 4. It receives the visible and/or infrared luminous flux emitted by the free surface 23 of metal contained in pouring gate 4. Sensor 22, of the same type as sensor 21, is directed toward stream 15 in order to transmit a signal representing the cross-section of stream 15 and, consequently, its rate of flow. A third optical sensor 24 is directed toward stream 16 flowing from flow-off gate 9 to supply a similar signal corresponding to the flow of stream 16. The quantity of metal contained in ladle 13 is detected indirectly by a position sensor 25 or directly by an optical or other type of sensor. Sensor 25 records any rotation of pulley 19 and generates a signal as a function of such rotation. Sensor 43 measures the height of the level of metal in flow-off gate 9 of ladle 7. Finally, in the plant illustrated in FIG. 1, a pressure sensor 26 is also provided for meauring the gas pressure within ladle . Various other safety devices are not shown in the drawing.

The control and regulating system makes it possible to act automatically both upon the position of ladle 13, in order to control the flow of stream 15, and upon the pressure within bell 10, in order to control the flow of stream 16. The means for such action comprise a reduction-gear motor 27 driving pulley 19 and valve 28 controlling the admission of gas to bell 10 through pipe 11.

Figure 2:
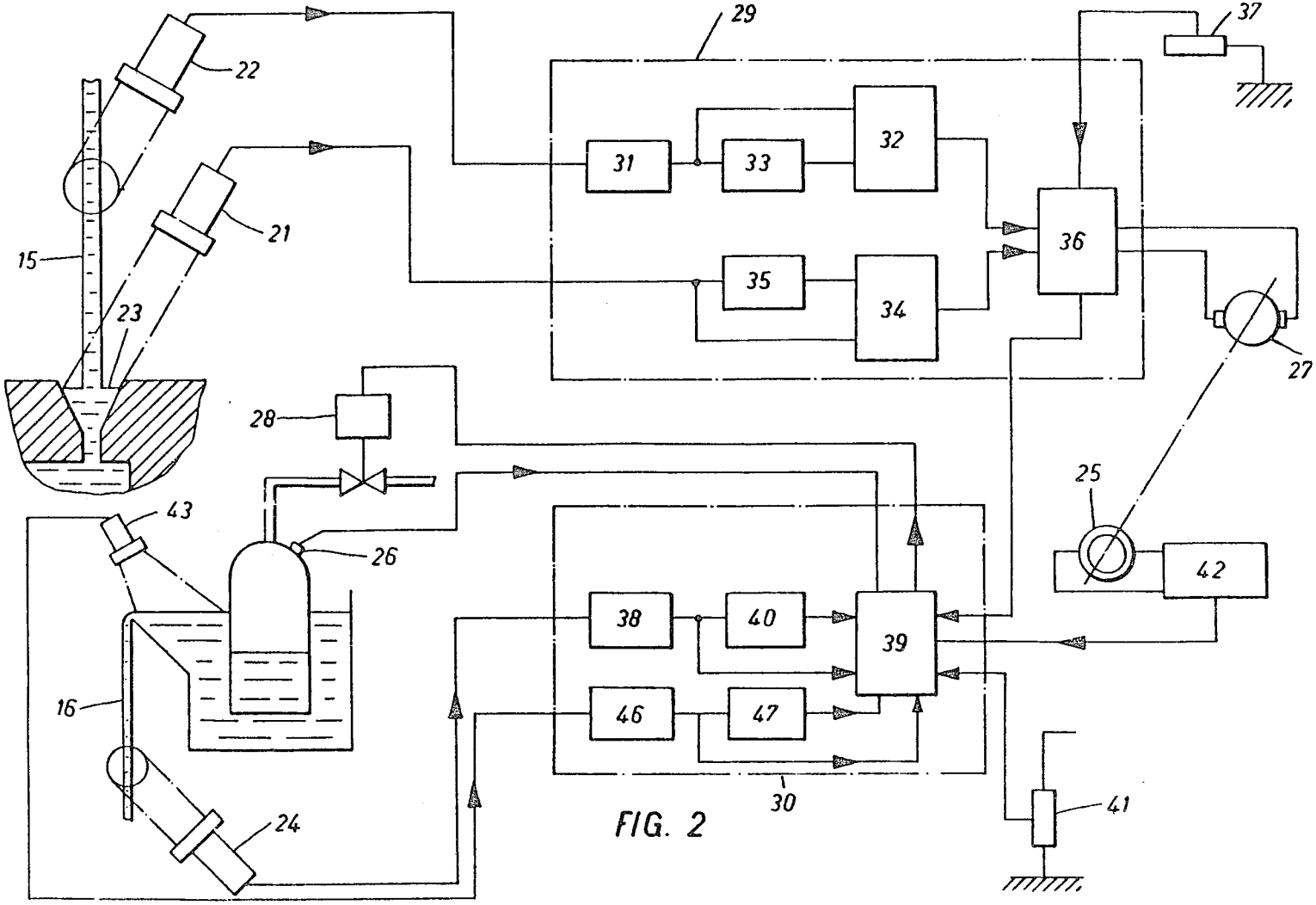
FIG. 2 is a simplified diagram of the control circuit.

FIG. 2 shows how these various control and regulating elements are connected to the necessary circuits in order to operate the plant. Reappearing in FIG. 2 are optical sensors 22 and 21 directed toward stream 15 and free surface 23, respectively, sensor 24 directed toward stream 16, sensor 43, pressure detector 26, motor 27, position sensor 25, and valve 28. Circuitry 29 and 30 forms part of two servo loops, the functions of which are as follows: Circuitry 29, forming part of the first servo loop, receives as input signals the signal corresponding to the width of stream 15 and the signal corresponding to level 23. The first of these signals is squared in a circuit 31 in order to form a signal proportional to the flow of stream 15. The output signal of circuit 31 is supplied both to a summing circuit 32 and to a differentiator 33, the output of which is likewise supplied to summing circuit 32 in order to form a signal corresponding to the flow of stream 15. The signal transmitted by sensor 21 is supplied to an adder 34 and to a differentiator 35, the output of which is likewise supplied to circuit 34. A signal representing level 23 and its variations appears at the output of circuit 34. The signals for surface level 23 and for the flow rate of stream 15 are supplied to a servo amplifier 36, which also receives a reference input from a reference voltage source 37. The output of servo amplifier 36 constitutes a control signal which drives motor 27 in order to cause tilting or righting of ladle 13 and thus to vary the flow of stream 15. The first servo loop tends to maintain the height of level 23 at a constant value during the filling of each mold 3.

Circuitry 30, forming part of the second servo loop, receives as an input signal the signal from sensor 24 corresponding to the width of stream 16. This signal is squared in a circuit 38, supplied to a servo amplifier 39 and to a differentiator 40, the output of the latter likewise being supplied to servo amplifier 39 for comparison. A reference signal generated by a reference voltage source 41 and the signal from sensor 26 are supplied to servo amplifier 39, which also receives a signal representing the position of ladle 13 formed in a circuit 42 on the basis of signals supplied by position sensor 25. The measurement of the level of metal in ladle 7, carried out by optical sensor 43, is likewise transmitted to circuitry 30 of the second servo loop. The signals corresponding to this measurement are processed in circuits 46 and 47 to be supplied to servo amplifier 39. Finally, the latter is also connected to servo amplifier 36 of the first servo loop so that the variations in level and in flow rate detected by sensors 21 and 22 influence the formation of the control signal for ladle 7. The output of servo amplifier 39 is connected to valve 28. Thus, the second servo loop controls valve 28 to regulate the flow of stream 16 so that the position of ladle 13 remains approximately constant.

Because of the high inertia of ladle 7 and the secondary effects brought about by the variations of pressure within bell 10, above all if they are rapid, the quantity of metal contained in ladle 13 cannot be maintained absolutely constant. However, variations of this quantity within certain limits may be tolerated.

This arrangement described above makes it possible to overcome completely the difficulties of regulation which have hitherto been encountered in feeding small-capacity molds succeeding one another at a rapid rate. Pressure ladle 7 can be equipped with heating inductors 8*a* and keep a large quantity of metal at a suitable temperature. It can feed a line such as casting line 1 without interruption. Even though the time constant of ladle 7 is high, the fact that it pours into tilting ladle 13, the volume of which is much greater than that of pouring gates 4, eliminates any unfavorable consequences. It may even be provided for stream 16 to flow continuously between casting operations. Thus, variations in flow of stream 16 are kept within relatively narrow limits, and the only consequence of the slowness of such variations is certain momentary variations in the quantity of metal contained in ladle 13.

On the other hand, because ladle 13 is a small-capacity tilting ladle, stream 15 is well governed and capable of adapting to the rapid variations demanded by the mold. Sensors 21 and 22 make it possible effectively to regulate the flow of stream 15 in such a way as to keep level 23 at a constant value during the filling of a mold 3 even if the operation lasts only four seconds, for instance. Although this is not shown in FIG. 2, sensor 21 can also be utilized to cause rapid righting of ladle 13 at the end of a pouring operation when level 23 increases beyond a certain limit. Stream 15 is then quickly cut off, and the casting line can advance. As stated above, stream 16 may either continue to flow into ladle 13 or be cut off during this time.

Still other improvements may also be added to the casting plant as described above. Thus, it is possible to fill the pressure ladle while casting operations are taking place. Hence the plant can operate continuously.

Another important advantage of the intermediate ladle is that it can be used as a metering and mixing receptacle for inoculant additivves, which may be poured into ladle 13 alongside stream 16. The rate of feed of these additives may be made dependent upon the rate of flow of stream 15.

It will be understood that the sensors might equally well be disposed otherwise than as shown in the drawing. Instead of continuously measuring the quantity of metal contained in ladle 13 by means of a measurement of the position of that ladle, it would just as well be possible to measure this quantity of metal by means of an optical sensor directed toward surface 17, or by any other means. Sensors of some other type might also be used.

The means for controlling the advance of molds 3 have not been described, for they are known means of which various types exist. In one particularly favorable embodiment, ladle 13 might be mounted in such a way that the lip of this ladle is movable in a horizontal plane through a translatory movement of the ladle. This would allow stream 15 to be directed in order to compensate for slight deviations between the positions of pouring gates 4 of different molds. Thus, stream 15 would always fall in the center of the pouring gate.

The casting plant described above may be further developed in various ways. For instance, there might be two intermediate ladles, in which case the pressure ladle would have two separate flow-off lips 9 pouring into two ladles 13 disposed side by side and capable of simultaneously filling double molds or two adjacent molds. The division of metal between the two intermediate ladles could then be regulated by tilting the pressure ladle from side to side.

No detailed description has been given of the optical sensors used in the plant described above since they are already known per se and are such as are found described in our co-pending U.S. Ser. No. 778,588.

Those skilled in the art of electronics will readily recognize that all the circuits shown in FIG. 2 as forming part of the servo loops may be produced without difficulty by utilizing IC technology.

What is claimed is:

1. A casting plant of the type equipped with automatic control means including a pouring ladle adapted to contain molten metal, intermediate means for receiving a feeding stream from said pouring ladle, said intermediate means being capable of containing a variable quantity of molten metal, and a casting line formed of closed molds movable successively into a filling position, each of said molds having a pouring gate for receiving a filling stream from said intermediate means when in said filling position, wherein said control means comprises a first control means for activating said intermediate means, thus acting upon the flow rate of said filling stream and upon said variable quantity of molten metal, a second control means for activating said pouring ladle, thus acting upon the flow rate of said feeding stream, first detecting means for continuously monitoring and indicating the height of the level of metal in said pouring gate during filling, second detecting means for continuously monitoring and indicating the quantity of metal in said intermediate means, said second detecting means being integral with said first control means, and a regulating circuit means including, among other possible items, only two servo loop, said first loop comprising said first detecting means and said first control means and being arranged for controlling the flow of said filling stream to maintain said level of metal at a constant height, and said second loop comprising said second detecting means and said second control means and being arranged for controlling the flow of said feeding stream to maintain said quantity of metal within narrow limits.

2. The casting plant of claim 1, wherein said intermediate means is a tilting ladle and said second detecting means comprise an angular-position sensor, and said second servo loop being adapted to maintain the angle of tilt of said tilting ladle substantially constant.

3. The casting plant of claim 2, wherein said second detecting means further comprise an optical sensor for continuously monitoring and indicating the flow rate of said feeding stream.

4. The casting plant of claim 1, further comprising a reference source for supplying a reference signal to said first servo loop.

5. The casting plant of claim 1, wherein said first servo loop further comprises third detecting means for comprising monitoring and indicating the flow rate of said filling stream, said first servo loop comprising first circuit means being acted upon by a signal from said third detecting means.

6. The casting plant of claim 1, wherein said second servo loop further includes fourth detecting means for monitoring and indicating the level of said molten metal in said pouring ladle, said second servo loop comprising second circuit means being acted upon by said fourth detecting means.

* * * * *